US005695088A

United States Patent [19]

Kasbohm

[11] Patent Number: 5,695,088

[45] Date of Patent: Dec. 9, 1997

[54] APPARATUS FOR SECURING A BAG IN A CONTAINER

[75] Inventor: Michael Kasbohm, St. Louis Park, Minn.

[73] Assignee: SpecTech, Inc., Minneapolis, Minn.

[21] Appl. No.: 433,080

[22] Filed: May 3, 1995

Related U.S. Application Data

[63] Continuation-in-part of Ser. No. 25,641, Jul. 7, 1994, Pat. No. Des. 358,692.

[51] Int. Cl.[6] ..... B65D 77/00

[52] U.S. Cl. ..... 220/404; 24/30.5 S; 248/314

[58] Field of Search ..... 220/403, 404, 220/697, 710, 735, 736, 669, 476; 24/30.5 R, 30.5 S; 248/95, 111, 113, 213.2, 314

[56] References Cited

U.S. PATENT DOCUMENTS

| | | | |
|---|---|---|---|
| D. 343,752 | 2/1994 | Corbin | D6/546 |
| 3,096,960 | 7/1963 | Kinney | 248/113 |
| 3,269,550 | 8/1966 | Marcus | 220/476 X |
| 3,561,077 | 2/1971 | Grant | 248/95 |
| 3,568,879 | 3/1971 | Box | 220/669 X |
| 4,027,774 | 6/1977 | Cote | 220/404 |
| 4,138,055 | 2/1979 | Harrison | 248/309.1 |
| 4,267,995 | 5/1981 | McMillan | 24/30.5 S X |
| 4,570,304 | 2/1986 | Montreuil et al. | 220/404 X |
| 4,631,783 | 12/1986 | Hayashi | 248/309.1 |
| 4,644,610 | 2/1987 | Fish | 248/309.1 |
| 4,852,844 | 8/1989 | Villaveces | 248/314 |
| 4,923,087 | 5/1990 | Burrows | 220/404 |
| 5,205,530 | 4/1993 | Fish | 248/309.1 |
| 5,271,589 | 12/1993 | Belaus | 248/99 |
| 5,307,585 | 5/1994 | Thompson | 248/314 X |

OTHER PUBLICATIONS

Photo of draupe towel holder on sale more than one year prior to filing date of Jul. 7, 1994.

*Primary Examiner*—Steven M. Pollard
*Attorney, Agent, or Firm*—Kinney & Lange, P.A.

[57] ABSTRACT

A method and apparatus for securing a trash bag in a container is disclosed, where the apparatus has a substantially flat main body. The main body has a front surface and a back surface and the back surface has a mounting member attached thereto. A retaining tab extends substantially perpendicular from the front surface of the main body. A central membrane is located on the retaining tab and has a number of slits which form a number of flaps in the membrane, which deform when pressed to received and retain the trash bag.

18 Claims, 2 Drawing Sheets

APPARATUS FOR SECURING A BAG IN A CONTAINER

This is a continuation in part of application Ser. No. 29\025,641 filed on Jul. 7, 1994, now U.S. Pat. No. D 358,692.

BACKGROUND OF THE INVENTION

The present invention relates to an apparatus and method for securing a bag in a container. In particular, the invention is an apparatus, and a method for using the same, that is adhered to a container to maintain the bag around a rim of the container to prevent the mess and hassle that occurs when a bag falls into the container.

Trash containers come in a variety of sizes. Garbage bags also come in a variety of sizes. Using a bag that is not the same size as the container oftentimes results in a mess. Sometimes, the bag does not stay on the outside of the rim of the container, which causes garbage to be spilled on the outside portion of the bag and soiling the container. An additional mess often ensues when one has to reach inside the container full of garbage to retrieve the top of the bag. Not only do the hands get dirty, clothing may get soiled and garbage is oftentimes spilled. If the bag to be used is much larger than the container, there is a large amount of excess bag hanging outside of the container, which is unsightly and can get in the way. Even when a bag is the correct size for the trash container, the bag sometimes falls into the container when garbage is dropped in.

To combat these problems, numerous remedies have been attempted. One such remedy is to tape the trash bags to the container. This is very time-consuming, the tape is typically not reusable, and oftentimes results in ripping the bag when it is time to remove the tape to empty the container. Another attempted remedy is to tie the bag when there is an excessive amount of baggage hanging over the rim. This is sometimes a daunting task for people with arthritic conditions or for kids, whose chores often include taking out the garbage.

SUMMARY OF THE INVENTION

The present invention is designed to overcome the above-identified hassles in a quick and inexpensive way. The present invention comprises a method and an apparatus for securing a trash bag in a trash container. The apparatus has a substantially flat main body having a front surface and a back surface, and having a mounting member, preferably an adhesive, on its back surface. A retaining tab extends substantially perpendicular from the front surface of the main body. There is a central membrane on the retaining tab that has a number of slits that form a number of flaps in the membrane. These flaps deform when pressed on to receive and retain the trash bag.

A trash bag is secured by mounting the apparatus to the outside wall of a container. The bag is then placed in the container and a small section of the top of the bag is pushed through the opening in the membrane formed by the slits. The bag is then fit around the entire rim of the container. Finally, more of the bag is pulled through the membrane until the bag is tight around the container. The bag is now held secure by the flaps of the membrane.

DETAILED DESCRIPTION OF THE PREFERRED EMBODIMENTS

Figure 1:
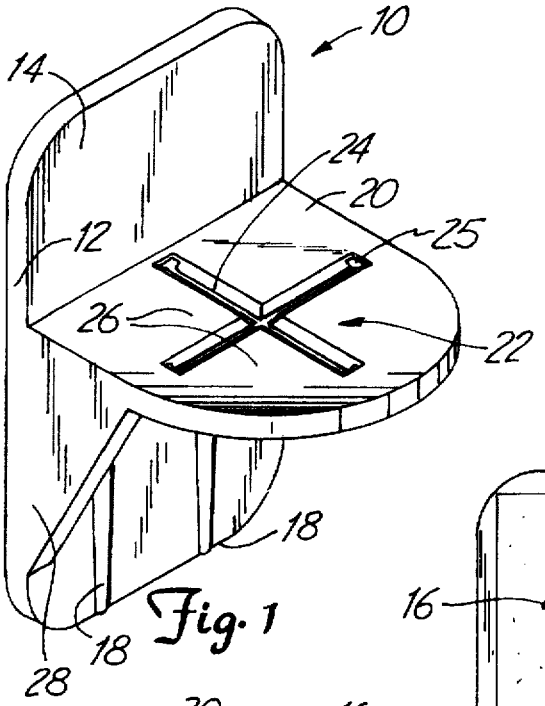
FIG. 1 is a perspective view of an apparatus according to the present invention as seen from the top front.
Figure 2:
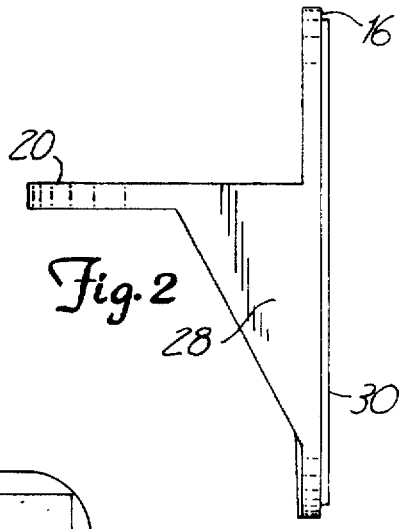
FIG. 2 is a side elevational view of the apparatus of FIG. 1.
Figure 3:
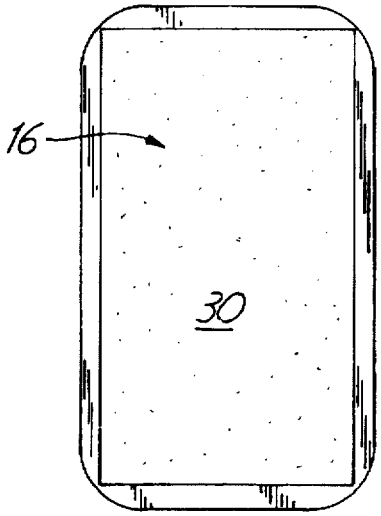
FIG. 3 is a rear elevational view of the apparatus of FIG. 1.

FIG. 1 illustrates an apparatus 10 for securing a bag in a container made according to the present invention. The apparatus 10 includes a main body 12, a retaining tab 20, a central membrane 22, and a mounting member 30 (not seen in FIG. 1).

The main body 12 has a front surface 14 and a back surface 16 (not seen in FIG. 1). The front surface 14 of the main body 12 contains a plurality of strengthening ribs 18. As their name suggests, the strengthening ribs 18 provide additional strength to the main body 12. The main body 12 is approximately 29 mm wide, 50 mm tall, and 2 mm thick in the preferred embodiment, but these dimensions could be changed without departing from the spirit of the invention.

The retaining tab 20 extends substantially perpendicular from the front surface 14 of the main body 12. The retaining tab 20 extends from the main body 12 across the entire width of the main body 12 and extends out approximately 27 mm. The retaining tab 20 extends from the main body 12 approximately ⅓ of the way down from the top of the main body 12. In the preferred embodiment shown, the retaining tab 20 is semi-circular, but the retaining tab 20 could also be rectangular, octagonal, or many other shapes without departing from the spirit of the invention. The retaining tab 20 is approximately 2 mm thick, which gives it some rigidity. Support members 28 are provided to support the retaining tab 20, for reasons to be described in greater detail below.

Figure 5:
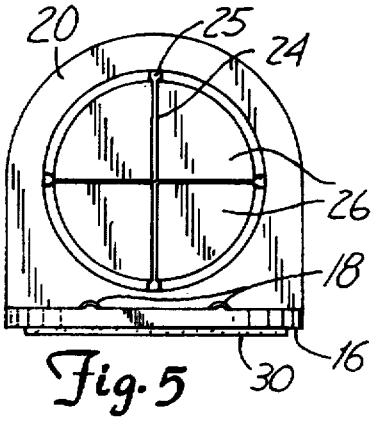
FIG. 5 is a bottom plan view of the apparatus of FIG. 1.
Figure 6:
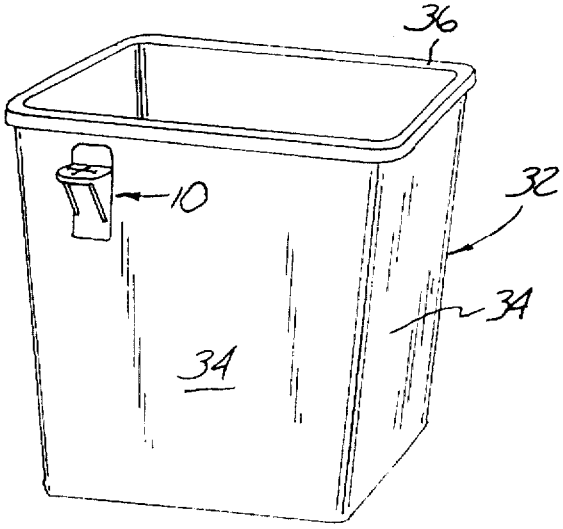
FIG. 6 is a perspective view of a trash container having the apparatus of FIG. 1 mounted to it.
Figure 7:
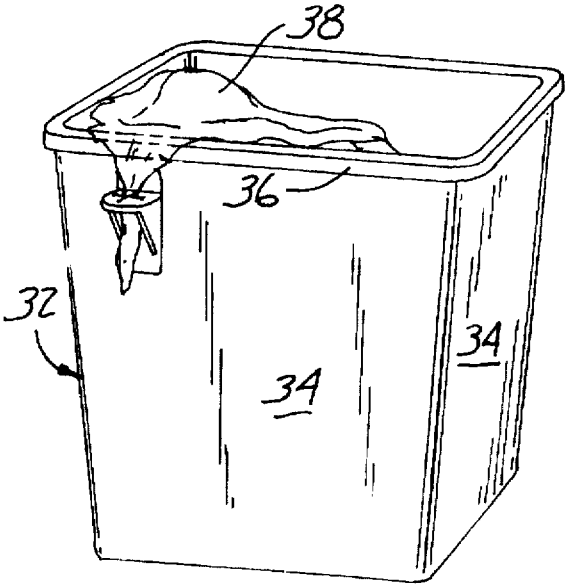
FIG. 7 is a perspective view of a trash bag in the container.
Figure 8:
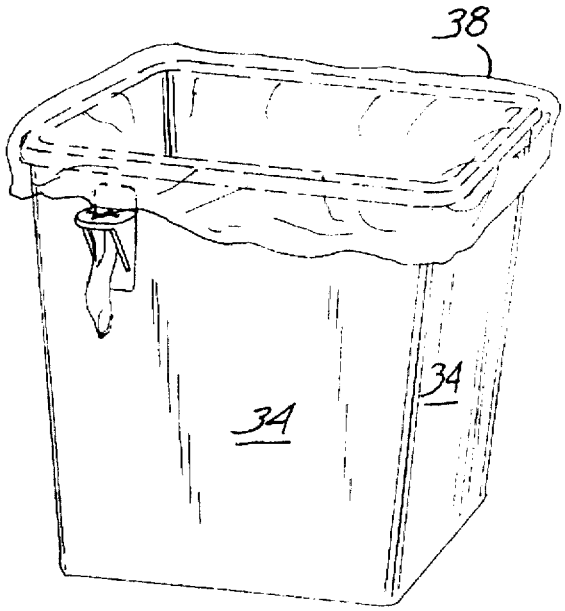
FIG. 8 is a perspective view of the trash bag being secured in the container by the apparatus of FIG. 1.
Figure 9:
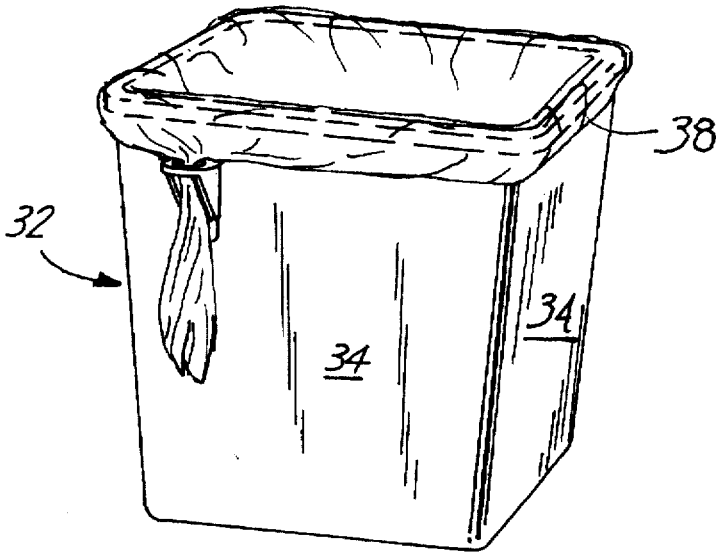
FIG. 9 is a perspective view of the trash bag secured in the container by the apparatus of FIG. 1.

The central membrane 22 is provided on the retaining tab 20 for receiving and securing the bag. As can be seen in greater detail in FIG. 5, the central membrane 22 is a circular membrane. A plurality of slits 24 are provided on the central membrane 22 which in turn define a plurality of flaps 26. Each of the slits 24 ends in a strain relief point 25. The central membrane 22 is approximately 1 mm thick, as opposed to the 2 mm thickness of the retaining tab 20, which allows the flaps 26 to be somewhat easily deformed to receive and retain the bag. In the preferred embodiment, the central membrane 22 is made of the same material as the rest of the apparatus 10.

Figure 4:
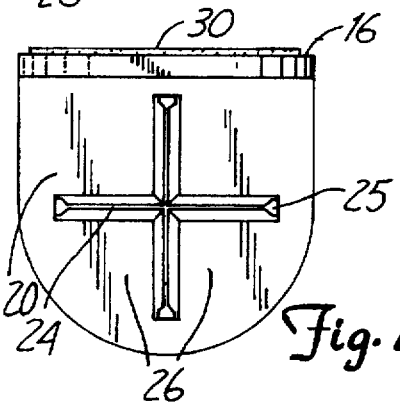
FIG. 4 is a top plan view of the apparatus of FIG. 1.

The slits 24 of the central membrane 22 dissect the membrane 22 into four substantially equal pie-shaped flaps 26. As can be seen in FIG. 4, the flaps 26 are beveled downward toward the slits 24 at their outermost edges. The beveled edges encourage and assist the trash bag through the opening in the membrane 22 when the flaps 26 are depressed.

As can be seen in FIGS. 2–5, the mounting member 30 is connected to the back surface 16 of the main body 12. In the preferred embodiment illustrated, the mounting member 30 is an adhesive two sided tape which is designed to adhere to numerous surfaces, such as plastic and rubber which trash containers are typically made from. It should be noted that other mounting members could also be used such as an elastic or rubber band connected to the apparatus 10 that fits around the container, or a pair of small screws attached to the apparatus 10 for fastening to the container.

In the preferred embodiment, the apparatus 10 of the present invention is an injected molded one piece unit made of plastic. A one piece injected molded unit is used in the preferred embodiment because it is inexpensive to produce. The apparatus of the present invention could be made with many other materials such as fiberglass, wood or metal without departing from the spirit of the invention. Additionally, the apparatus need not be formed from one piece or be entirely made of the same material.

FIGS. 6–9 illustrate a method of using the apparatus 10 of the present invention. A waste container 32 is illustrated in FIGS. 6–9. The waste container 32 has a plurality of side walls 34 and a rim 36 connecting the side walls. The apparatus 10 is adhered to the outside of one of the side walls 34 of the container 32, preferably near the rim 36. A plastic bag 38 is provided and placed into the container 32. A small portion of the bag 38 is then pushed through the central membrane 22 of the retaining tab 20 by displacing the flaps 26. The displacement of the flaps 26 is made easier by having the flaps 1 mm thick. The bag 38 is then fit around the entire rim 36 of the container 32. Once this is done, more of the bag 38 is pulled through the membrane 22 until the bag 38 is tight around the rim 36 of the container 32. The bag is now secured in the container. The support members 28 are important to the design of the apparatus 10 during the steps of pushing the bag 38 through the central membrane 22 and pulling additional amounts of the bag 38 through the membrane. Without the support members 28, the retaining tab 20 could break off from the main body 12.

Although the present invention has been described with reference to preferred embodiments, workers skilled in the art will recognize that changes may be made in form and detail without departing from the spirit and scope of the invention.

What is claimed is:

1. An apparatus for securing a bag in a container, the apparatus comprising:

a retaining tab securable on a surface of the container so that the retaining tab extends from and is substantially perpendicular to the surface of the container; and a central membrane on the retaining tab having a plurality of slits defining a plurality of flexible, pie shaped flaps in the central membrane for receiving and securing the bag, each flap having a first edge and a second edge wherein the first edge of each flap is immediately adjacent the second edge of an adjacent flap and each flap has a vertex wherein the vertex of each flap is immediately adjacent the vertex of all the other flaps.

2. The apparatus of claim 1 further including a plurality of support members supporting the retaining tab.

3. The apparatus of claim 1 wherein the first and second edges of the flaps have a beveled shape to encourage the bag through the slits and to prevent the bag from escaping the slits.

4. The apparatus as in claim 1 wherein the central membrane is circular.

5. The apparatus of claim 1 wherein the central membrane has a thickness approximately ½ of the thickness of the retaining tab.

6. A one piece apparatus for securing a bag in a container, the apparatus comprising:

a main body having a front surface, a back surface, and a rib extending along the front surface for strengthening the main body;

a mounting member attached to the back surface of the main body for securing the apparatus to an outer surface of the container;

a retaining tab extending from the main body, the retaining tab being substantially perpendicular to the main body so that the retaining tab is substantially perpendicular to the surface of the container; and a plurality of support members extending between the retaining tab and the front surface of the main body to prevent bending movement of the retaining tab relative to the main body, a central membrane area on the retaining tab, the membrane area having a plurality of generally radially disposed slits defined a plurality of generally pie shaped flexible flaps in the central membrane area for receiving and securing the bag, each flap having a first edge and a second edge with the edges of flaps being beveled on the top side of the flap and the first edge of each flap being immediately adjacent the second edge of an adjacent flap and each flap having a vertex with the vertex of each flap being immediately adjacent the vertex of all the other flaps, the central membrane having a thickness one half the thickness of the retainer tab, wherein the bevels along the edges of the flaps facilitate insertion, from the top side of the membrane, of a portion of a liner bag through the slits and between the flexible flaps in the membrane, and wherein the thinned edges adjacent the bottom side facilitate retention by the flexible flaps of the liner bag through the slits wherein the retaining tab and the central membrane have a top surface and a bottom surface and wherein the top surface of the retaining tab is contiguous with the top surface of the central membrane and the bottom surface of the central membrane is recessed from the bottom surface of the retaining tab.

7. The apparatus as in claim 6 wherein the main body is substantially flat.

8. The apparatus as in claim 6 wherein the mounting member is an adhesive.

9. The apparatus as in claim 6 wherein the central membrane is circular.

10. The apparatus of claim 1 wherein the apparatus is configured for being mounted to the container and includes:

a main body having a front surface and a back surface; and a mounting member attached to the back surface of the main body for securing the apparatus to a surface of the container.

11. The apparatus of claim 10, wherein the main body contains at least one rib for strengthening the main body.

12. The apparatus of claim 10 wherein the main body is substantially flat.

13. A container system for securing a bag, the system comprising:

a container having a plurality of sidewalls and a rim connecting the sidewalls to define a chamber for receiving the bag, the sidewalls having inner and outer walls;

a retaining tab extending from an outer wall of one of the plurality of sidewalls, wherein the retaining tab is substantially perpendicular to the outer wall; and a central membrane on the retaining tab having a plurality of slits defining a plurality of flexible, pie shaped flaps in the central membrane for receiving and securing a bag, each flap having a first edge and a second edge with the wherein the first edge of each flap is immediately adjacent the second edge of an adjacent flap and each flap has a vertex with the vertex of each flap being immediately adjacent the vertex of all the other flaps.

14. The apparatus of claim 1 wherein each flap further includes a vertex defining a junction between the first and second edge of each flap, and wherein the vertex of each flap is in selective contact with a vertex of adjacent flaps.

15. An apparatus for securing a bag in a container, the apparatus comprising:

a retaining tab securable on a surface of the container so that the retaining tab extends from and is substantially perpendicular to the surface of the container; and a central membrane on the retaining tab having a plurality of slits defining a plurality of flexible flaps in the central membrane for receiving and securing the bag, each flap having a first edge and a second edge wherein the first edge of each flap is immediately adjacent the second edge of an adjacent flap, and wherein the edges of the flaps have a beveled shape, and each flap has a vertex with the vertex of each flap being immediately adjacent the vertex of all the other flaps, and wherein the retaining tab and the central membrane have a top surface and a bottom surface and wherein the top surface of the retaining tab is contiguous with the top surface of the central membrane and the bottom surface of the central membrane is recessed from the bottom surface of the retaining tab, and the central membrane has a thickness one half the thickness of the retainer tab.

16. The apparatus of claim 15 wherein each flap has a base and each of the first and second edges of each flap have a cut out portion at the base of the flap so that the first edge of one flap and the second edge of an adjacent flap together define a strain relief point between adjacent flaps.

17. The apparatus of claim 1 wherein the retaining tab and the central membrane have a top surface and a bottom surface and wherein the top surface of the retaining tab is contiguous with the top surface of the central membrane and the bottom surface of the central membrane is recessed from the bottom surface of the retaining tab so that the central membrane has a thickness one-half the thickness of the retaining tab.

18. In a retainer for a liner bag of a container such as a waste or recycling receptacle wherein the container has an outer wall, the improvement comprising:

a retaining tab, the tab having a mounting portion securable on the outer wall of the container and a retainer portion extending outwardly from the mounting portion; and a central membrane area on the retainer portion, the membrane area having a top side and a bottom side, and the membrane area having a plurality of generally radially disposed slits therethrough which define a plurality of generally pie-shaped, flexible flaps in the membrane area, adjacent flaps having opposed edges alongside the slits, with the edge of each flap being beveled on the top side of the flap to be thinner adjacent its respective slit than the rest of the flap, wherein the edge of each flap is immediately adjacent the edge of an adjacent flap and each flap has a vertex with the vertex of each flap being immediately adjacent the vertex of all of the other flaps so that the slaps occupy substantially the entire central membrane, and wherein the bevels along the edges of the flaps facilitate insertion, from the top side of the membrane, of a portion of a liner bag through the slits and between the flexible flaps in the membrane, and wherein the thinned edges adjacent the bottom side facilitate retention by the flexible flaps of the liner bag through the slits.

* * * * *